United States Patent [19]

De Marco

[11] 4,027,680

[45] June 7, 1977

[54] SAFETY CIGARETTE HOLDER AND ASH RETAINING DEVICE

[76] Inventor: Nicholas De Marco, 5011 Loyola St., Westminster, Calif. 92683

[22] Filed: Dec. 22, 1975

[21] Appl. No.: 643,503

[52] U.S. Cl. ..... 131/175

[51] Int. Cl.[2] ..... A24D 1/12; A24D 13/16

[58] Field of Search ..... 131/175, 174, 179, 191, 131/193

[56] References Cited

UNITED STATES PATENTS

| | | | |
|---|---|---|---|
| 2,113,734 | 4/1938 | Lykos et al. | 131/175 |
| 2,189,878 | 2/1940 | Brady | 131/175 |
| 2,518,131 | 8/1950 | Fook | 131/175 |
| 2,711,743 | 6/1955 | Gibbs | 131/175 |
| 3,362,415 | 1/1968 | Ellis | 131/175 |

*Primary Examiner*—Stephen C. Pellegrino
*Attorney, Agent, or Firm*—Jack C. Munro

[57] ABSTRACT

A safety cigarette holder and ash retaining device comprising a pair of members being hingedly connected together and movable between an open position and a closed position, a cigarette holding tip being secured to one of said members and capable of holding a cigarette in a cantilevered manner with the cigarette being located within the internal chamber formed within both of said members when said members are in the closed position, air ventilation holes being provided within one of said members in order to supply air to the cigarette, locking means to secure together said first member to said second member when in the closed position.

1 Claim, 7 Drawing Figures

SAFETY CIGARETTE HOLDER AND ASH RETAINING DEVICE

BACKGROUND OF THE INVENTION

A common problem with cigarette smokers is that the smoker is likely to place a cigarette down upon an object, such as a table. The smoker may forget that he has so placed the cigarette on the table and after a period of time the cigarette will burn a slight depression into the surface of the table.

Additionally some people prefer to smoke just prior to retiring at night. It is not at all uncommon for the smoker to fall asleep with the cigarette still lit with the result that the cigarette will fall to either the floor or the person's bedding and result in a fire. It is not uncommon for each year that several thousand structures are totally burned and also several thousand people each year lose their lives in this manner.

SUMMARY OF THE INVENTION

The device of this invention is believed to be summarily described in the Abstract Of The Disclosure and reference is to be had thereto.

The primary objective of this invention is that when used will absolutely prevent a cigarette from catching fire any exterior objects.

DETAILED DESCRIPTION OF THE SHOWN EMBODIMENT

Figure 1:
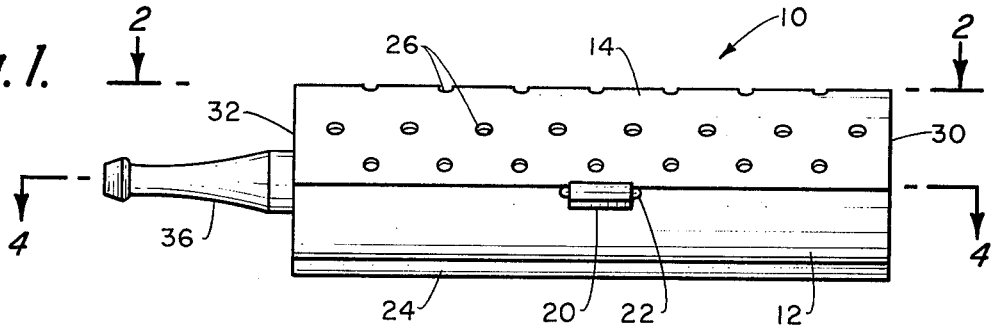
FIG. 1 is a side elevational view of the cigarette holder device of this invention.
Figure 2:
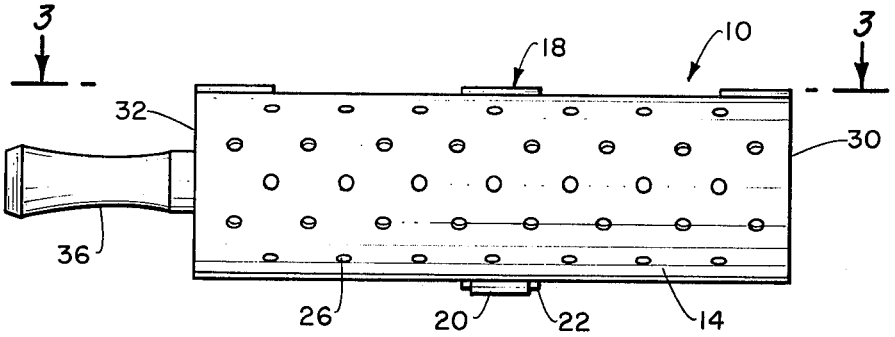
FIG. 2 is a plan view of the cigarette holder device of this invention taken along line 2—2 of FIG. 1.
Figure 3:
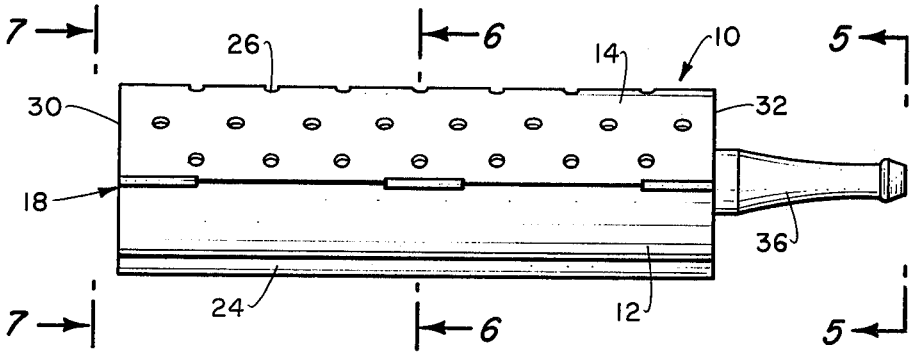
FIG. 3 is a back view of the cigarette holder device of this invention taken along line 3—3 of FIG. 2.
Figure 4:
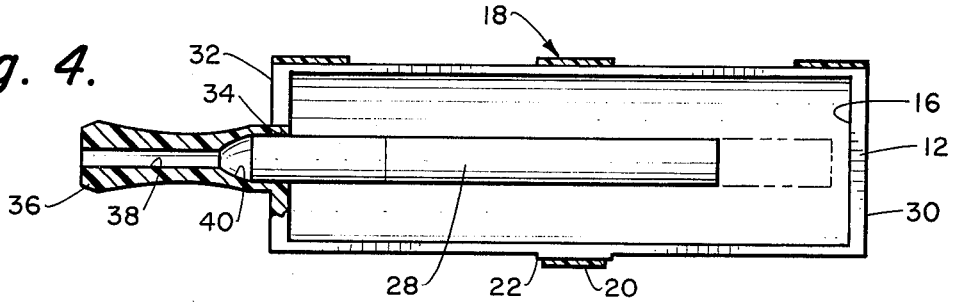
FIG. 4 is a cross-sectional view of the cigarette holder device of this invention taken along line 4—4 of FIG. 1.
Figure 5:
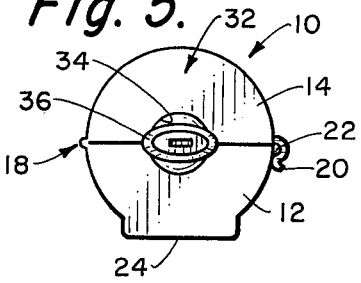
FIG. 5 is a forward end view of the cigarette holder device of this invention taken along line 5—5 of FIG. 3.
Figure 6:
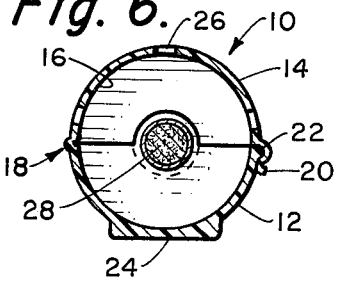
FIG. 6 is a cross-sectional view taken along line 6—6 of FIG. 3.
Figure 7:
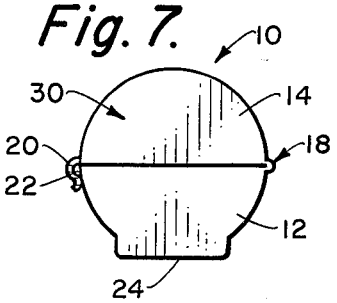
FIG. 7 is a rear end view of the cigarette holder device of this invention taken along line 7—7 of FIG. 3.

Referring particularly to the drawing, there is shown in FIG. 1 the cigarette holding device 10 of this invention which is composed of a first member 12 and a second member 14. Both the first member 12 and the second member 14 are formed basically in the shape of half a cylinder so that when the members 12 and 14 are located in an abutting relationship that a solid cylindrical unit is formed. This abutting relationship is to be defined as a closed position.

Both the first member 12 and the second member 14 are formed in a basically hallow configuration so that when the members are in the closed position, an internal chamber 16 is formed. The first member 12 and the second member 14 are interconnected together through a hinge joint 18. It is envisioned that the members 12 and 14 will be formed of a fire-proof plastic material with the hinge joint 18 being actually small, thin segments of the plastic material. This type of a hinge joint 18 is deemed to be conventional and is frequently referred to as a "living hinge".

On the opposite sides of the members 12 and 14 there is to be located a locking means, such as a plastic locking tab 20 which cooperates with an enlarged bead 22. With the locking tab 20 disengaged from the bead 22, the second member 14 can be hingedly moved with respect to the first member 12 permitting access into the interior chamber 16.

The first member 12 is basically a solid configuration having no openings formed in its peripheral surface. It has been found desirable that the lower surface of the member 12 will be formed to include a flattened section 24 so as to facilitate placement of the cigarette holder 10 upon a flat surface, such as a table.

Formed within the second section 14 are a great number of air access openings 26. These openings 26 are to facilitate passage of air into the internal chamber 16, this air being necessary in order to effect burning of the cigarette 28 which is to be located within the internal chamber 16. It is to be noted that the portion of the internal chamber 16 which is defined by the first member 12 functions as an ash retaining chamber, and after complete burning of the cigarette 28, the ashes are then to be removed prior to the burning of another cigarette.

The rear end wall 30 is a closed solitary structure when the members 14 and 12 are interconnected together. The forward end wall 32 includes an opening 34 formed therein. This opening 34 is to provide access to a cigarette holding tip 36. This cigarette tip 36 is to facilitate operation of the cigarette by being placed in the smoker's mouth. This tip 36 is deemed to be basically conventional and includes an internal smoke passing opening 38. This tip 36 is only secured to the first member 12 but when the second member 14 is in the closed position with the member 12, a close fitting relationship does occur between the second member 14 and the tip 36.

In order to operate the cigarette holder device of this invention, the operator will disengage the locking tab 20 and hingedly move the second member 14 to the open position with respect to the first member 12. The operator then grasps a conventional cigarette 28 and then places the mouth piece end of the cigarette into the cigarette holder cavity 40 formed within the tip 36. The cigarette 28 is then supported in a cantilever manner within the internal chamber 16. The operator then closes the member 14 with respect to member 12 engaging locking tab 20 with bead 22. It is to be understood that the cigarette 28 has been placed within the device after being lit. The operator then proceeds to smoke the cigarette by sucking on the tip 36.

When the cigarette 28 has been completely burned, the operator then reopens the device and removes the ashes which have collected within the portion of the internal chamber 16 defined by the first member 12. Any remnant portion of the cigarette 28 is also removed. The device is then ready to be reused.

What is claimed is:

1. A cigarette holding device comprising:

a first member and a second member, said second member being integrally hingedly connected to said first member, said second member being movable between a closed position and an open position, said closed position being with said first members and said second members cooperating together to form a closed chamber, said open position permitting access to said closed chamber;

with said members in said closed position said members cooperating to form a forward end wall and a rear end wall, said forward end wall being closed, said rear end wall having a first opening therein, a cigarette supporting tip piece being mounted within said first opening, a cigarette being adapted to be placed within said tip piece and extend within said chamber in a cantilevered manner;

said first member being a solid unitary structure so as to function as a receptacle for the cigarette ash as the cigarette burns;

said second member having a plurality of openings therein to permit air to pass therethrough in order to facilitate burning of the cigarette; and locking means interconnecting said first member and said second member when in the closed position so as to securely retain said first member and said second member in said closed position, said locking means includes a locking tab integrally formed upon said first member which is to connect with an enlarged bead on the said second member, said locking tab to biasingly engage said enlarged bead.

* * * * *